US006995783B2

(12) United States Patent
Burdenko et al.

(10) Patent No.: US 6,995,783 B2
(45) Date of Patent: Feb. 7, 2006

(54) THERMAL PRINTER ASSEMBLY

(75) Inventors: Michael N. Burdenko, Wellesley, MA (US); George O. MacCollum, Bellingham, MA (US); James K. Prueitt, Dedham, MA (US); Juan C. Vandijk, Sudbury, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 10/743,632

(22) Filed: Dec. 22, 2003

(65) Prior Publication Data

US 2004/0174424 A1 Sep. 9, 2004

Related U.S. Application Data

(60) Provisional application No. 60/436,208, filed on Dec. 23, 2002.

(51) Int. Cl.
*B41J 25/304* (2006.01)

(52) U.S. Cl. ..... 347/197

(58) Field of Classification Search ..... 347/197, 347/198, 220; 400/120.16, 120.17, 82
See application file for complete search history.

(56) References Cited

U.S. PATENT DOCUMENTS

| | | | | |
|---|---|---|---|---|
| 4,660,052 A | * | 4/1987 | Kaiya et al. | 347/200 |
| 4,811,036 A | | 3/1989 | Gaskill et al. | 346/76 PH |
| 5,003,323 A | | 3/1991 | Onuki et al. | 346/76 PH |
| 5,132,704 A | * | 7/1992 | Nakagawa | 347/197 |
| 5,138,336 A | * | 8/1992 | Goto | 347/198 |

FOREIGN PATENT DOCUMENTS

EP 0 619 188 B1 10/1994

* cited by examiner

*Primary Examiner*—Huan Tran

(57) ABSTRACT

There is described a thermal printer assembly including a plurality of elongated thermal print heads and a frame adapted to fixedly mount and align the plurality of print heads in parallel across a single print media path. The frame may be adapted to align the print heads to print across substantially different lateral portions of the print media path.

12 Claims, 5 Drawing Sheets

THERMAL PRINTER ASSEMBLY

REFERENCE TO RELATED APPLICATION

This application claims the benefit of provisional application Ser. No. 60/436,208, filed Dec. 23, 2002.

TECHNICAL FIELD

The present invention relates to thermal printer assemblies and particularly to such assemblies in which a plurality of print heads are used to span a larger print media widths.

BACKGROUND

Modern thermal print heads have achieved levels of resolution based upon integrated circuit construction techniques which can locate a great number of individual heating elements in close proximity to each other. This advantage of resolution creates a limitation on the total span of the print head due to the possibility of faults occurring in the semiconductor, both in the manufacturing process and later in the printing application. Larger print spans have been achieved by aligning two or more smaller print heads to achieve the wider span. Also, due to the resolution achieved, relatively small misalignment between such multiple print heads are easily noticed in the resulting printed product. Even misalignments of as little as one pixel can be visually determined.

The construction and accuracy of multiple thermal print head alignment is further challenged by the need to substantially squeeze the print media against the thermal print head to provide good thermal conductivity.

SUMMARY OF THE INVENTION

The present invention relates to a thermal printer assembly including a plurality of elongated thermal print heads and a frame adapted to fixedly mount and align the plurality of print heads in parallel to print across a single print media path. The frame may be adapted to align the print heads to print across substantially different lateral portions of the print media path. Each of the elongated print heads has a printing length, and the frame may be adapted to align the print heads to print across a print media width, which is substantially equal to a total of the printing lengths of the plurality of print heads. Each of the print heads may be positioned to print at a different sequential location along the print media path.

The assembly may include a separate platen roller adapted for pressuring print media against each of the print heads. Each platen roller may be approximately as long as its respective print head. Each platen roller determines a curvature in the print media path, and the assembly may include a member having a low friction surface adapted to mimic that curvature in alignment with a platen roller across a lateral portion of the print media path not spanned by such platen roller. The platen roller and the low friction surface may be aligned across the print media path at a single sequential position along the print media path.

The frame may be adapted to position the plurality of thermal print heads to print from a first side of the print media path, and the assembly may further include a second plurality of elongated thermal print heads fixedly mounted to the frame for printing from a second opposing side of the print media path.

The variations described above provide improved print head alignment and heat dissipation for greater reliability. Double sided printing can be efficiently accomplished at no expense to the recited benefits.

BRIEF DESCRIPTION OF THE DRAWINGS

For a better understanding of the invention as well as other objects and further features thereof, reference is made to the following detailed description of various preferred embodiments thereof taken in conjunction with the accompanying drawings wherein.

DESCRIPTION OF THE PREFERRED EMBODIMENTS

Figure 1:
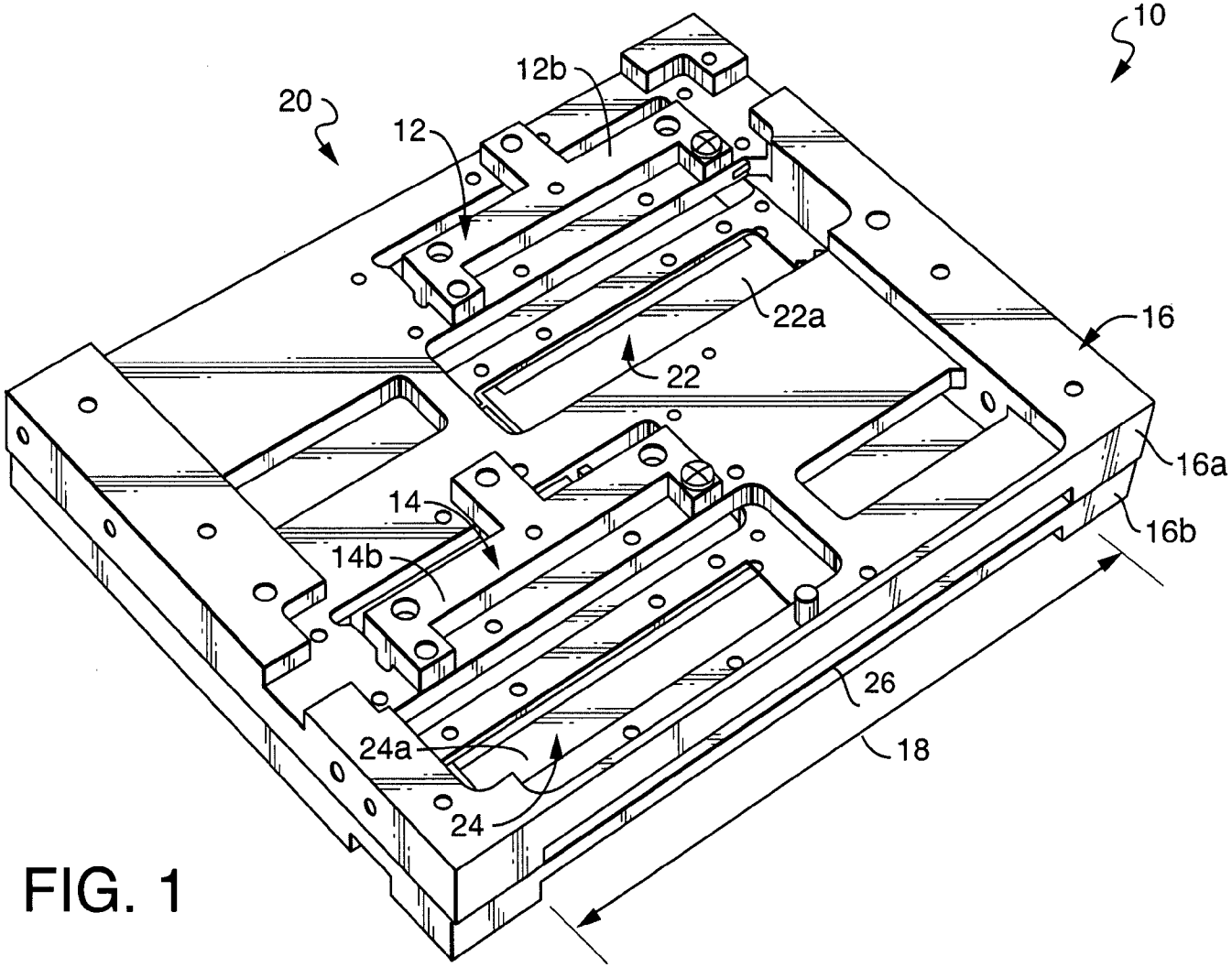
FIG. 1 is a perspective view of one side of an embodiment of a thermal print head assembly according to the invention.

FIG. 1 shows a thermal print head assembly 10 generally including a plurality of elongated thermal print heads 12 and 14 and a frame 16. Frame 16 mounts print heads 12 and 14 to print across a print media path 18 with print heads 12 and 14 being oriented in parallel and orthogonally to the direction of print media movement indicated by arrows 20.

Frame 16 is provided in two complementary sections 16*a* and 16*b* with section 16*a* mounting print heads 12 and 14 and section 16*b* mounting an additional plurality of print heads 22 and 24. For the purpose of this disclosure, print heads 12, 14, 22 and 24 necessarily include a semiconductor portion, 22*a* and 24*a*, shown for print heads 22 and 24 and a holder portion, 12*b* and 14*b*, shown for print heads 12 and 14. The semiconductor portions 22*a* and 24*a* are the printing side of the print heads and include hundreds of semiconductor heating elements formed per linear inch of the elongated semiconductor elements.

By this arrangement of frame sections 16*a* and 16*b*, each mounting a plurality of print heads, 12 and 14 and 22 and 24, respectively, assembly 10 defines print media path 18 passing between frame sections 16*a* and 16*b* and through slot 26. Print heads 12, 22, 14 and 24 are thereby arranged to print sequentially, in that order, along print media located in print media path 18.

Figure 2:
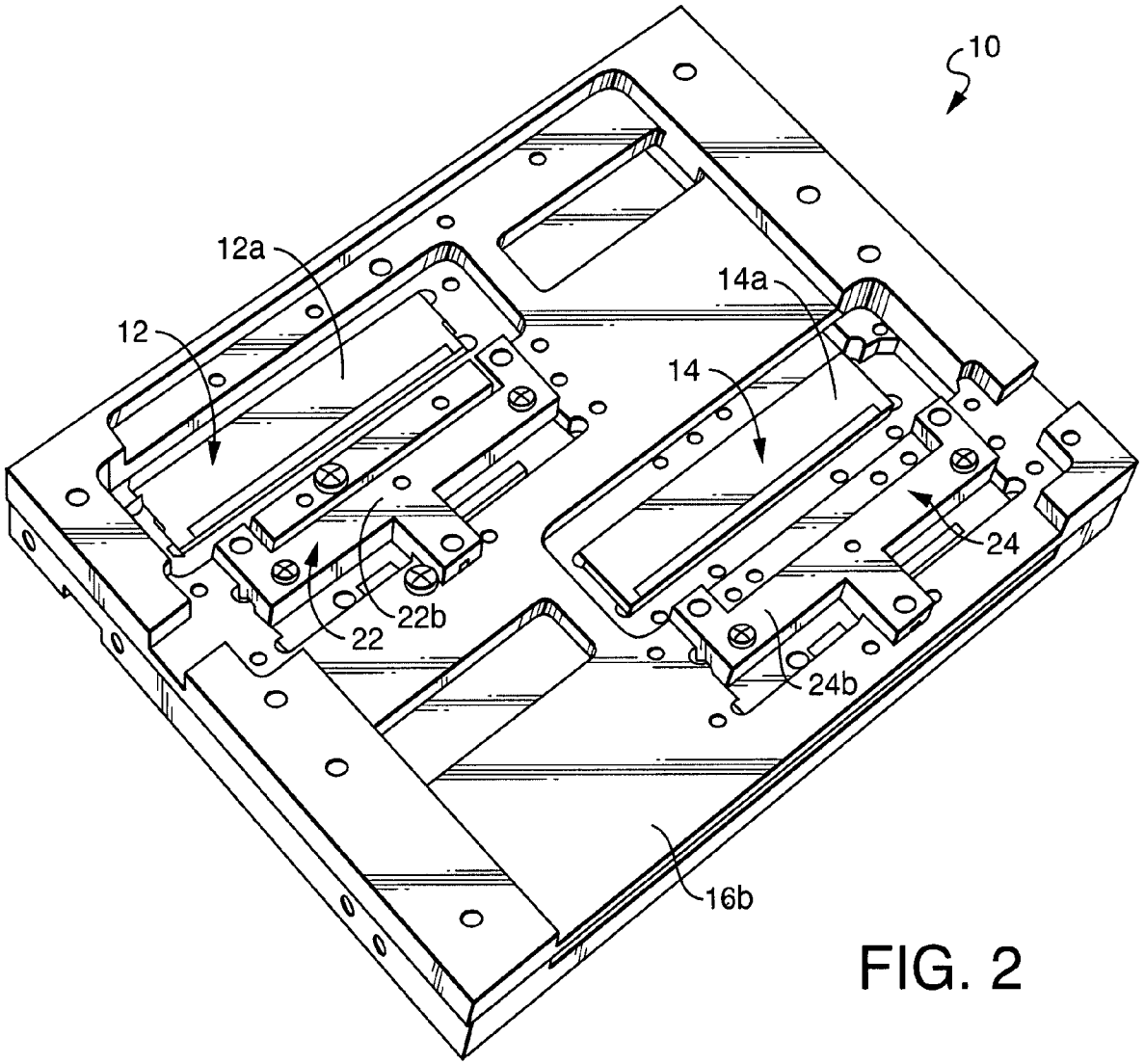
FIG. 2 is a perspective view of the other side of the assembly of FIG. 1.

FIG. 2 shows the opposite side of assembly 10 and the respective opposite sides of print heads 12, 22, 14 and 24. The fixed mounting of these thermal print heads provides excellent heat dissipation for the heating elements in the semiconductor portions and also eliminates the wear and tear of movement on wires used for driving those heating elements.

By this arrangement frame 16*a* positions print heads 12 and 14 to print across substantially different lateral portions of print media path 18. Print heads 12 and 14 and 22 and 24 are shown to be elongated with an identifiable print length and frame 16 positions print heads 12, 14, 22 and 24 across the width of print media path 18, which width is substantially equal to the total of the printing lengths of either plurality of print heads 12 and 14 or 22 and 24. Each of the thermal print heads is positioned to print at a different sequential location along print media path 18 in the direction of print media travel 20.

Figure 3:
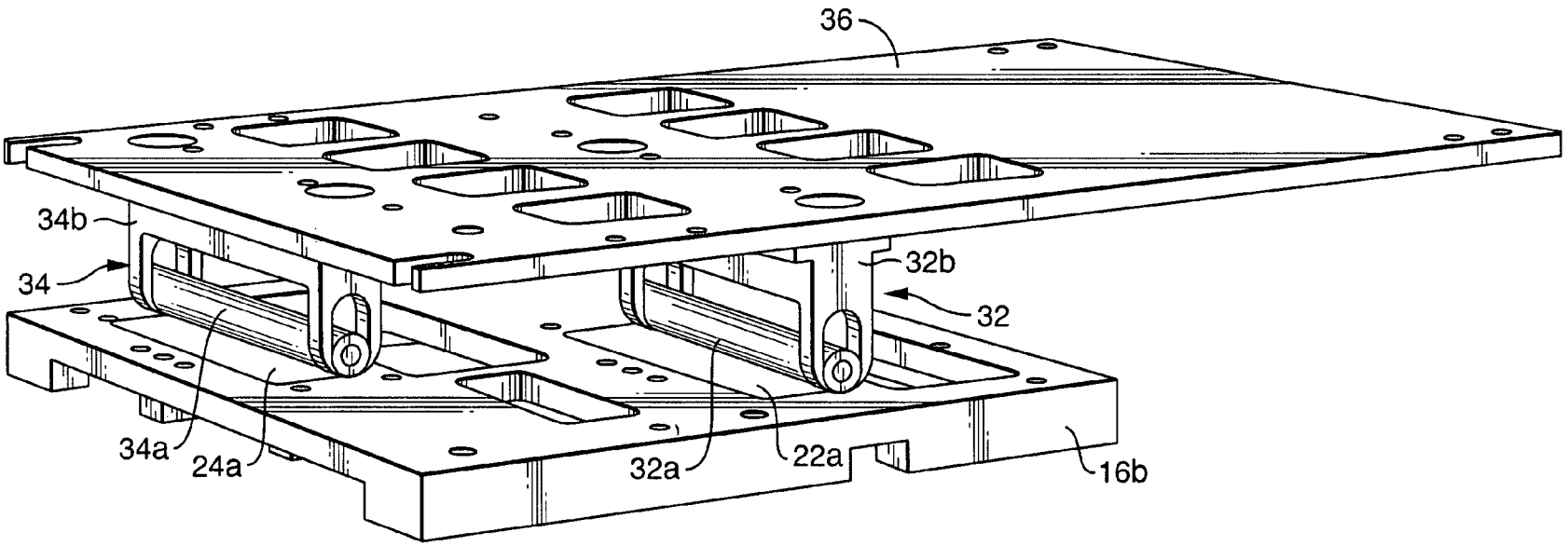
FIG. 3 is a perspective view of a portion of the assembly of FIGS. 1 and 2 in combination with an additional printer component.

FIG. 3 shows frame section 16*b* of assembly 10 (FIG. 1) in combination with a pair of platen roller assemblies 32 and 34 being mounted on a support member 36. Each platen roller assembly includes a platen roller 32*a* and 34*a*, respectively, and a mounting frame 32*b* and 34*b*, respectively. Platen rollers 32*a* and 34*a* are aligned with the semiconductor surfaces 22*a* and 24*a* of respective print heads 22 and 24 (FIGS. 1 and 2) in a position for biasing print media located therebetween against the respective print heads 22 and 24. Platen rollers 32*a* and 34*a* are approximately as long as, or only slightly longer than, the printing length of print heads 22 and 24, and platen rollers 32*a* and 34*a* are further each spring biased from their respective mounting frames 32*b* and 34*b* for allowing rollers 32*a* and 34*a* to conform as necessary to their respective print heads 22 and 24. Frame section 16*a* is not present in FIG. 3 for purposes of clarity in showing the interaction between print heads 22 and 24 and platen roller assemblies 32 and 34.

Whereas, existing thermal printers mount multiple print heads along a single platen roller, the present application of individual platen rollers to each separate print head provides a better interface function between the platen roller and print head to control thermal contact between print media and the print heads. The improved roller to print head contact of separate rollers thereby improves the performance of the present fixed print head arrangement. Better conformance between the print heads and their associated platen rollers is provided by the use of the shorter, and thereby stiffer, platen rollers.

Figure 4:
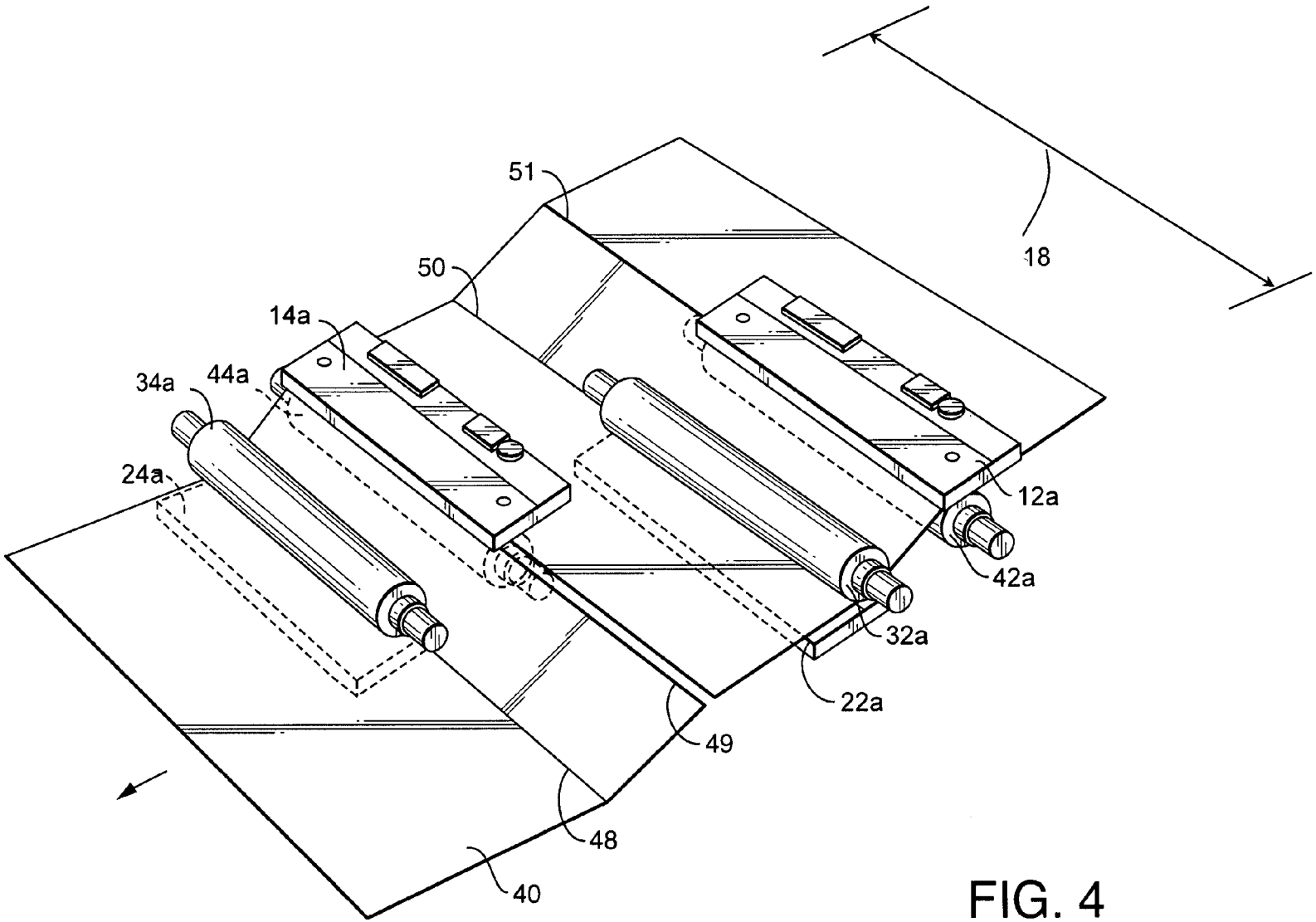
FIG. 4 is a perspective diagram of a print media path through the assembly of FIGS. 1 and 2.

FIG. 4 shows the effective path for a piece of print media 40 as it passes sequentially across print head semiconductor portions 12*a* and 22*a* and 14*a* and 24*a* and is pressed there against by respective platen rollers 42*a* and 32*a* and 44*a* and 34*a*. Print media 40 is shown in FIG. 4 with a multiplicity of lines 48–51 extending there across. These lines 48–51 represent bends in the print media path which are determined by platen rollers 42*a*, 32*a*, 44*a*, 34*a*. Because thermal print head semiconductor portions 22*a* and 24*a*, for example, and their respective platen rollers 32*a* and 34*a* only extend partially across the width of the print media path 18, it is important for wrinkling prevention to support print media 40 in the areas of the bends or lines 48–51 to maintain the curvature of print media 40 across the lateral portions thereof not supported by the respective platen rollers.

It will be noted that the print heads can overlap each other in the direction of print media travel, as illustrated in FIG. 4. By arranging the print heads to overlap "electronic stitching" of images can be carried out.

Figure 5:
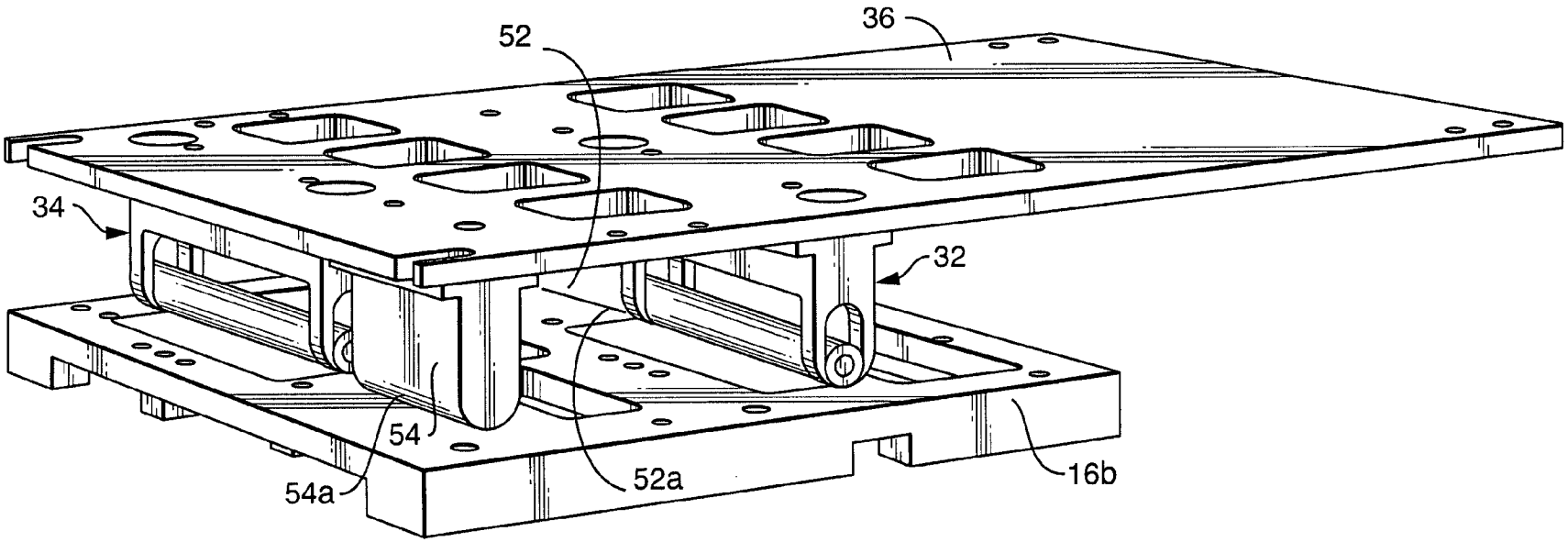
FIG. 5 is a perspective view of the content of FIG. 3 in combination with yet another component.

For the purpose of enhancing wrinkle prevention, FIG. 5 shows the frame section 16*b* and support member 36 of FIG. 3 in combination with platen roller assemblies 32 and 34, with the addition of media support members 52 and 54. Members 52 and 54 each includes a low friction surface 52*a* and 54*a*, respectively, adapted to mimic the curvature of their respective platen rollers 32*a* and 34*a*. For this purpose, media support members 52 and 54 are mounted in alignment with respective platen roller assemblies 32 and 34, respectively, in an orthogonal direction across the width of the print media path 18. In this manner, the areas of print media 40 (FIG. 4) located along lines 48–51 are properly supported through the indicated curvatures of print media 40 thereby preventing unwanted distortion and wrinkling of print media 40.

It should be noted that although media support member 54 is shown as a separate member it can be integrated into the frame.

By the arrangement described above, frame 16 positions the plurality of print heads 12 and 14 to print from a first side of the print media path 18 and further positions a second plurality of print heads 22 and 24 for printing from a second opposing side of the print media path 18.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

What is claimed is:

1. A thermal printer assembly, comprising:

a plurality of elongated thermal print heads;

a frame adapted to fixedly mount and align said plurality of print heads in parallel to print across a single print media path;

a separate platen roller adapted for pressuring print media against each of said print heads, wherein each said platen roller determines a curvature in said print media path; and a member having a low friction surface adapted to mimic said curvature of at least one said platen roller in alignment therewith across a lateral portion of the print media path not spanned by said at least one platen roller.

2. The assembly of claim 1, wherein said frame is adapted to align said print heads with overlap in the direction of the print media path to print across substantially different lateral portions of said print media path.

3. The assembly of claim 2, wherein each of said plurality of elongated print heads has a printing length, and further wherein said frame is adapted to position said print heads to print across a print media width, which is substantially equal to a total of said printing lengths of said plurality of print heads.

4. The assembly of claim 3, wherein each of said plurality of thermal print heads is positioned to print at a different sequential location along said print media path.

5. The assembly of claim 4, wherein each said platen roller is not substantially longer than its respective elongated thermal print head.

6. The assembly of claim 1, wherein said platen roller and said low friction surface are aligned across said print media path at a single sequential position along said print media path.

7. The assembly of claim 1, wherein said frame is adapted to position said plurality of thermal print heads to print from a first side of said print media path, and further comprising a second plurality of elongated thermal print heads fixedly mounted to said frame for printing from a second opposing side of said print media path.

8. A thermal printer assembly comprising:

a first plurality of elongated thermal print heads;

a frame adapted to fixedly mount and align said first plurality of print heads in parallel to print across a single print media path;

a second plurality of elongated thermal print heads fixedly mounted to said frame;

wherein said frame is adapted to position said first plurality of thermal print heads to print from a first side of said print media path, and to position said second plurality of elongated thermal print heads for printing from a second opposing side of said print media path.

9. The thermal printer assembly of claim 8 wherein said frame is adapted to align said print heads with overlap in the direction of the print media path to print across substantially different lateral portions of said print media path.

10. The thermal printer assembly of claim 9 wherein each of said plurality of elongated print heads has a printing length, and further wherein said frame is adapted to position said print heads to print across a print media width, which is substantially equal for each of said first and second pluralities of print heads to a total of said printing lengths of said respective plurality of print heads.

11. The thermal printer assembly of claim 10 wherein each of said first plurality of thermal print heads and said second plurality of thermal print heads is positioned to print at a different sequential location along said print media path.

12. The thermal printer assembly of claim 11 wherein each said platen roller is not substantially longer than its respective elongated thermal print head.

* * * * *